United States Patent [19]

Tielrooy

[11] Patent Number: 4,722,271

[45] Date of Patent: Feb. 2, 1988

[54] MANDREL ROTATION ASSEMBLY FOR INTERMITTENTLY OPERATED TAPERED SIDEWALL PRINTER

[75] Inventor: Robert W. Tielrooy, Amstelveen, Netherlands

[73] Assignee: Van Dam Machine Corporation, West Paterson, N.J.

[21] Appl. No.: 940,964

[22] Filed: Dec. 12, 1986

[51] Int. Cl.[4] ..... B41F 17/18

[52] U.S. Cl. ..... 101/38 R; 101/39

[58] Field of Search ..... 101/38–40

[56] References Cited

U.S. PATENT DOCUMENTS

| | | | |
|---|---|---|---|
| 1,541,429 | 6/1925 | McMillan | 101/6 |
| 2,221,323 | 11/1940 | Gammeter | 101/40 |
| 2,799,223 | 7/1957 | Dubuit | 101/38 R |
| 2,881,699 | 4/1959 | Hakogi | 101/39 |
| 2,891,468 | 6/1959 | Taylor | 101/39 |
| 3,302,579 | 2/1967 | Edwards | 101/39 |
| 3,388,658 | 6/1968 | Cummings | 101/38 R |
| 3,537,187 | 11/1970 | Cvacho | 101/40 |
| 3,934,500 | 1/1976 | Jackson | 101/38 A |
| 4,044,667 | 8/1977 | Jackson | 101/38 R |
| 4,048,916 | 9/1977 | Silverman | 101/40 |

FOREIGN PATENT DOCUMENTS

| | | | |
|---|---|---|---|
| 1107245 | 5/1961 | Fed. Rep. of Germany | 101/39 |
| 2642505 | 3/1978 | Fed. Rep. of Germany | 101/38 A |
| 2312373 | 12/1976 | France | 101/40 |
| 8303402 | 5/1985 | Netherlands | 101/38 R |
| 612831 | 6/1978 | U.S.S.R. | 101/38 R |

*Primary Examiner*—Clyde I. Coughenour

*Attorney, Agent, or Firm*—Popper, Bobis & Jackson

[57] ABSTRACT

Apparatus for printing on frusto-conical cups includes a mandrel wheel intermittently rotatably movable to a loading, pre-treatment, printing, first cure, second cure, and unloading station; a plurality of mandrel assemblies rotatably mounted on the mandrel wheel for holding the containers on the mandrel wheel; a stationary support at each station, each stationary support including a slot therein; a mandrel rotation assembly for rotating the mandrel assemblies and containers at the pre-treatment and first and second cure stations, the mandrel rotation assembly including a resilient rubber ring rotatably mounted adjacent to the plurality of mandrel assemblies in concentric relation with the mandrel wheel, a mounting assembly for rotatably mounting the resilient ring in concentric relation to the mandrel wheel, a drive mechanism for continuously rotating the resilient ring, a biasing assembly for biasing the resilient ring into engagement with each mandrel assembly at the pre-treatment and first and second cure stations to rotate the containers thereat, the mounting assembly including a clamp for clamping the ring and a ball bearing assembly for rotatably mounting the clamp assembly adjacent to the plurality of mandrel assemblies, the drive mechanism including a belt in engagement with the clamp assembly for rotating the clamp assembly and a motor for controlling the belt to continuously drive the clamp assembly, and the biasing assembly including a roller rotatably mounted to each station for engaging the resilient ring with each roller being movable toward and away from the resilient ring, and a locking assembly positioned in a respective slot for locking each roller at a fixed position with respect to the resilient ring.

13 Claims, 4 Drawing Figures

MANDREL ROTATION ASSEMBLY FOR INTERMITTENTLY OPERATED TAPERED SIDEWALL PRINTER

BACKGROUND OF THE INVENTION

This invention relates generally to apparatus for printing on the exterior surfaces of containers, and more particularly, is directed to an assembly for rotating the mandrels on which the containers are held.

In general, a variety of machines for applying decorative finishes to plastic frusto-conical cups are known. Such machines include an intermittently rotatable mandrel wheel having a plurality of spaced, radially directed mandrels located on the periphery of the mandrel wheel for holding the cups thereon. After each cup is received on a corresponding mandrel at the loading station, the mandrels are intermittently rotated with the mandrel wheel to a pre-treatment station, a printing station, a cure station and finally to an unloading station at which the cup thereat is removed from the respective mandrel. At the pre-treatment station, the plastic cup is subjected to a glass flame or electrical discharge which provides better adherence of the ink to the cup at the subsequent printing station. At the printing station, a printing blanket is brought into contact with each of the cups, to place a decoration on the outer frusto-conical surface thereof, and at the subsequent cure station, the ink is cured by ultraviolet light.

In order to provide a uniform pre-treatment and cure to each cup, the mandrels are rotated or spun at the pre-treatment and cure stations. Conventionally, this has been accomplished by a separate roller mechanism which contacted the mandrel and rotated the same at the pre-treatment and cure stations. Accordingly, a separate motor and roller wheel have conventionally been provided at each station for such purpose. This has proven to be extremely costly and ineffective.

U.S. Pat. No. 4,543,883 discloses an apparatus for printing on frusto-conical cups in which the mandrels intermittently move through 16 different positions for each revolution of the mandrel wheel or turret. During such movement, all of the mandrels are continuously rotated about their respective rotational axis by means of a continuously rotating ring gear which rotates the mandrels through respective pinions. Because of this arrangement, different mandrels cannot be selectively rotated, while not rotating the remaining mandrels.

U.S. Pat. No. 3,934,500 discloses an apparatus for printing on cylindrical or frusto-conical containers with an ultraviolet light ink, in which a turret or mandrel wheel includes a plurality of mandrels spaced therearound. The turret is rotated in synchronism to register each mandrel in turn at a loading station, printing station, drying station, and an unloading station. Each of the mandrels is secured on the outer end of a drive shaft rotatably mounted to the turret, the axis of the shaft being radially disposed. A bevel gear is secured on the inner end of the shaft. Therefore, with this apparatus, all of the mandrels rotate continuously in synchronism with the intermittent indexing movements of the turret, in a manner similar to that of U.S. Pat. No. 4,543,883. See also U.S. Pat. No. 3,645,201, which describes another arrangement in which a gear is permanently in mesh with bevel gears for rotating all of the mandrels.

In addition, with these latter arrangements, the mandrels are rotated by the same drive that drives the machine, that is, the mandrel wheel. It is sometimes desirable to adjust the speed of rotation of the mandrels without changing the rotational speed of the mandrel wheel. This adjustment, however, cannot be made with these machines. U.S. Pat. Nos. 2,425,928; 3,962,970; and 3,977,318 disclose other apparatus for printing on frusto-chonical cups.

OBJECTS AND SUMMARY OF THE INVENTION

Accordingly, it is an object of the present invention to provide a mandrel rotation assembly for an intermittently operated tapered side wall printer that avoids the above difficulties encountered in the prior art.

More particularly, it is an object of the present invention to provide a mandrel rotation assembly for an intermittently operated tapered side wall printer that can rotate selected mandrels.

It is another object of the present invention to provide a mandrel rotation assembly for a tapered side wall printer, having a single drive for rotating selected mandrels.

It is still another object of the present invention to provide a mandrel rotation assembly for a tapered sidewall printer, in which the rotational speed of the mandrels can be adjusted independently of the rotational speed of the mandrel wheel.

In accordance with an aspect of the present invention, apparatus for decorating containers includes a mandrel wheel rotatably movable to a plurality of different stations; a plurality of mandrel assembly means mounted on the mandrel wheel for holding the containers on the mandrel wheel; and means for rotating the containers at selected ones of the stations, the means for rotating including a resilient ring rotatably mounted adjacent to the plurality of mandrel assembly means, drive means for continuously rotating the resilient ring, and biasing means for biasing the resilient ring into engagement with each mandrel assembly means at the selected stations to rotate the containers thereat.

In accordance with another aspect of the present invention, apparatus for decorating containers includes a mandrel wheel rotatably movable to a plurality of different stations; a plurality of mandrel assembly means mounted on the mandrel wheel for holding the containers on the mandrel wheel; a stationery support at each station, each stationery support including a slot therein; means for rotating the containers at selected ones of the stations, the means for rotating including a resilient ring rotatably mounted adjacent to the plurality of mandrel assembly means, mounting means for rotatably mounting the resilient ring in concentric relation to the mandrel wheel, drive means for continuously rotating the resilient ring, and biasing means for biasing the resilient ring into engagement with each mandrel assembly means at the selected stations to rotate the containers thereat, the mounting means including clamp means for clamping the ring and bearing means for rotatably mounting the clamp means adjacent to the plurality of mandrel assembly means, the drive means including belt means in engagement with the clamp means for rotating the clamp means and motor means for controlling the belt means to drive the clamp means, and the biasing means including roller means rotatably mounted at each station for engaging the resilient ring with each roller means being movable toward and away from the resilient ring and locking means positioned in a respective slot for locking each roller means at a fixed position with respect to the resilient ring.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
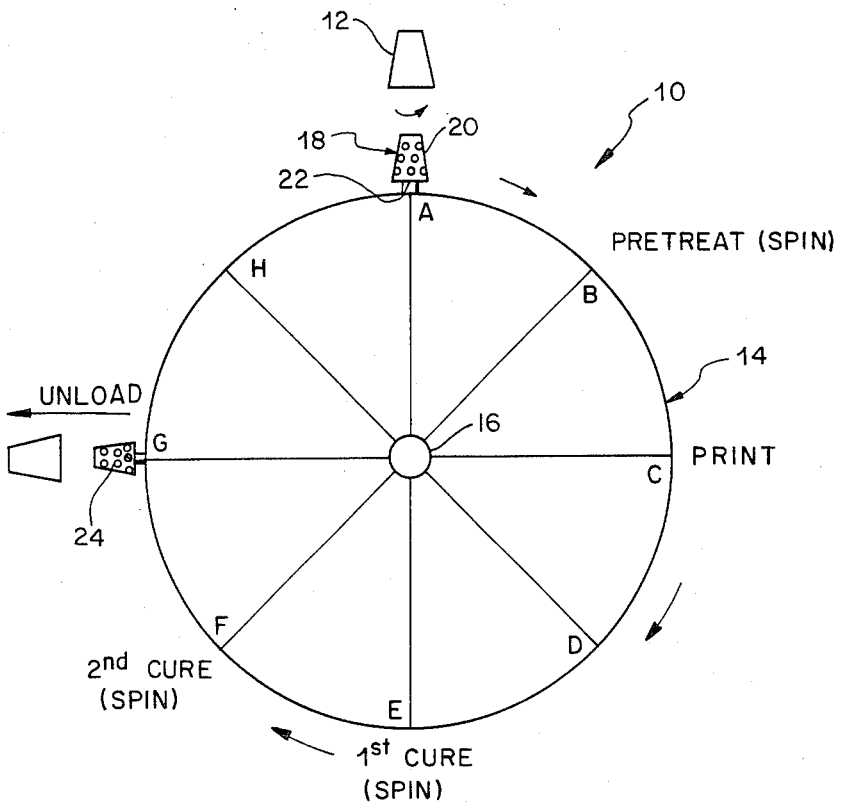
FIG. 1 is a schematic drawing of a tapered side wall printer with which the present invention can be used.
Figure 2:
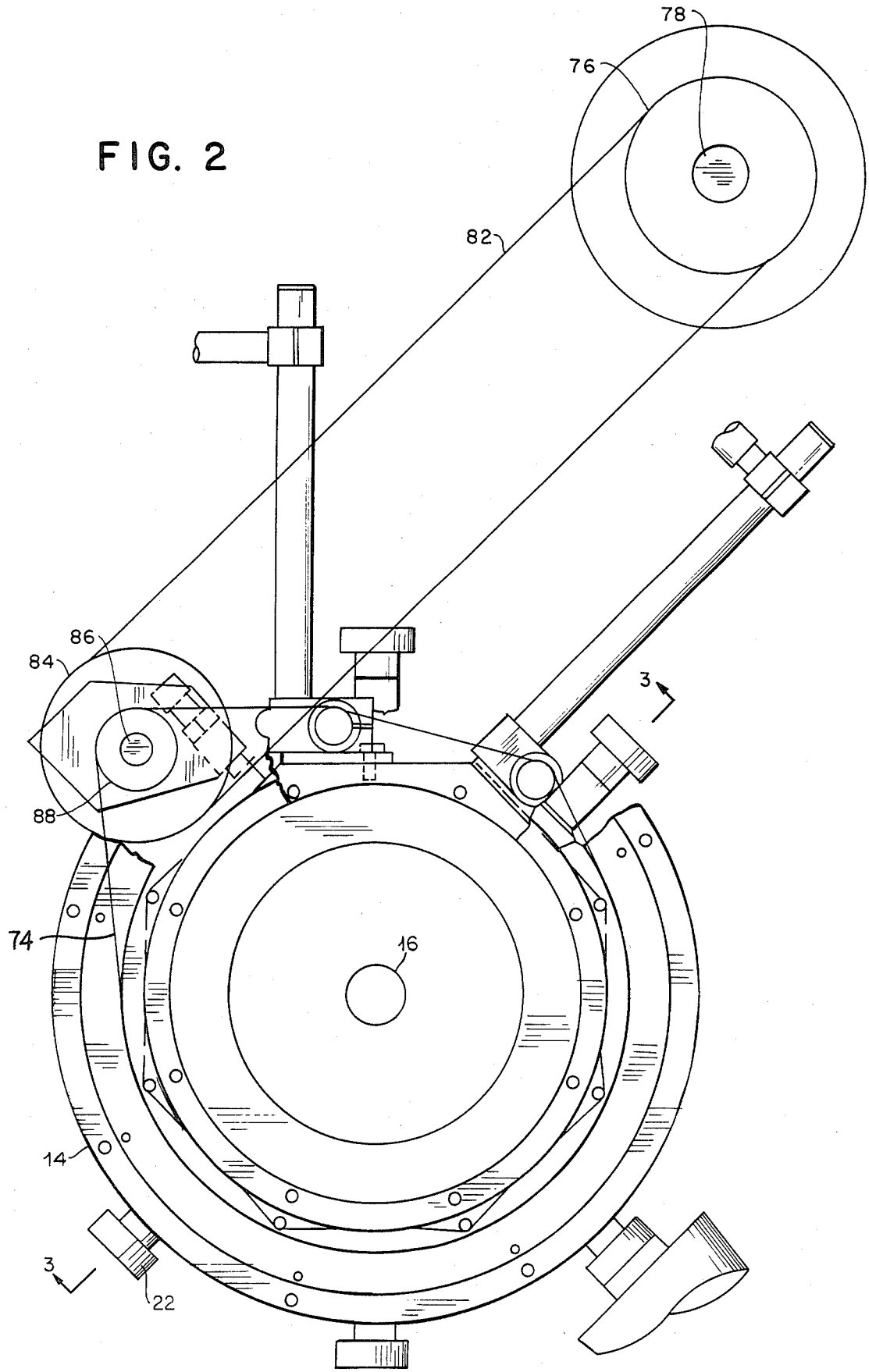
FIG. 2 is a front elevational view of a tapered side wall printer having a mandrel rotation assembly according to the present invention.

Referring to the drawings in detail, and initially to FIGS. 1 and 2, an intermittently operated decorating apparatus 10 with which the present invention can be used, for printing on the external surfaces of containers, such as frusto-conical cups 12, includes an intermittently rotatable mandrel wheel 14 rotatably mounted on a central shaft 16. A plurality of regularly spaced mandrel assemblies 18 are rotatably mounted at the circumferential periphery of mandrel wheel 14 and extend radially outward therefrom.

Each mandrel assembly 18 includes a container holding section 20 which essentially has a frusto-conical configuration to correspond to the configuration of cups 12. Each container holding section 20 is axially fixed on a shaft 22 which is rotatably mounted by any conventional means to the circumferential periphery of mandrel wheel 14 so as to extend radially outward therefrom. In addition, each container holding section 20 is formed with a plurality of apertures 24 on the external surface thereof which are in fluid communication with at least one conduit extending through the container holding section 22. Each conduit is in fluid communication at its opposite end with either a vacuum supply (not shown) or pressurized air supply (not shown), the reasons for which will be readily apparent from the description which follows.

As shown, there are eight mandrel assemblies 18 rotatably mounted to mandrel wheel 14, although this number may be varied. Thus, in operation, a cup 12 is dropped from above onto the mandrel assembly 18 at position A which is the loading station. At such time, a vacuum is applied through apertures 24 to firmly hold the cup 12 thereon.

Figure 3:
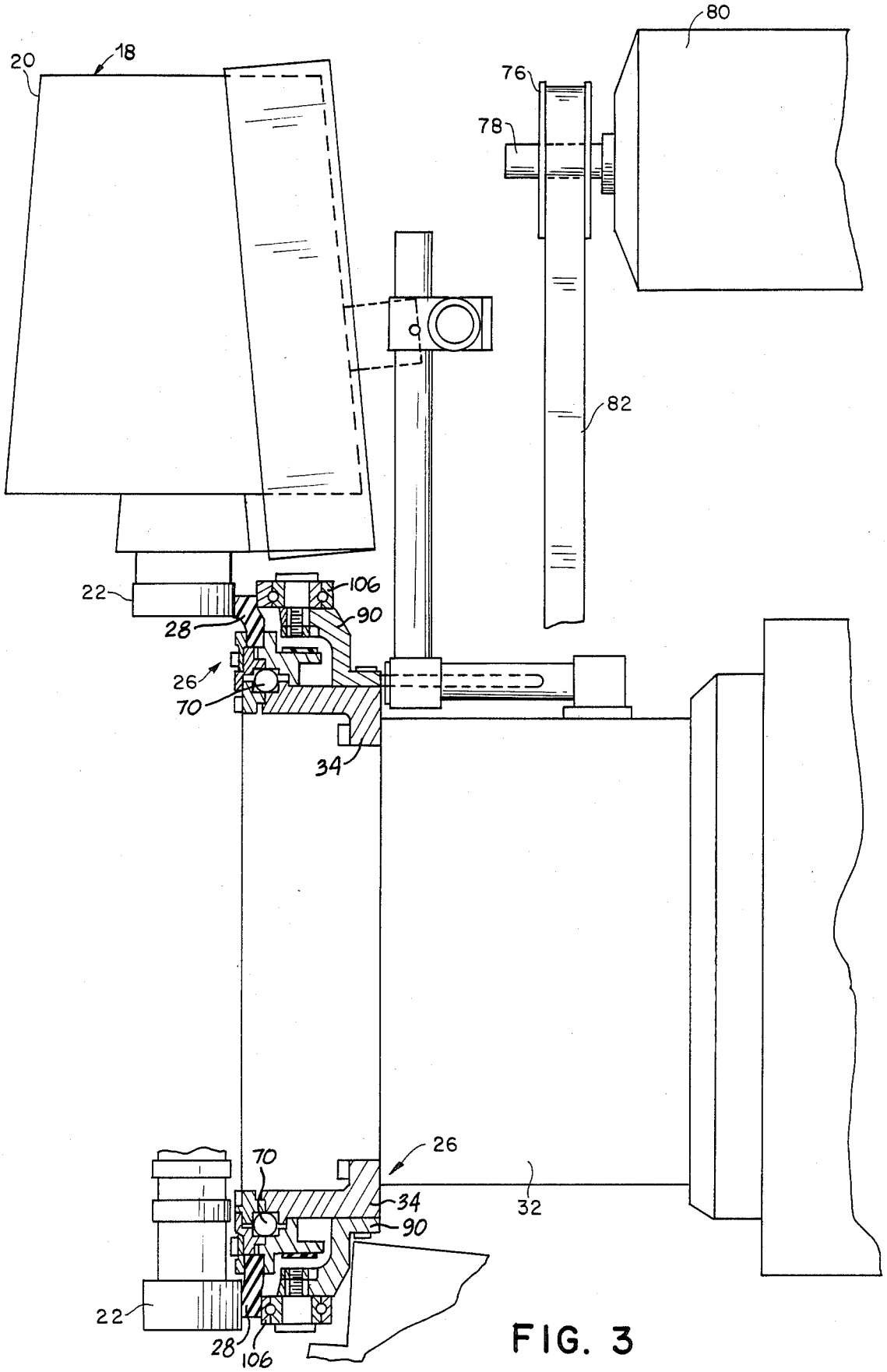
FIG. 3 is a partial, cross-sectional view of the tapered side wall printer of FIG. 2 taken along line 3–3 thereof.
Figure 4:
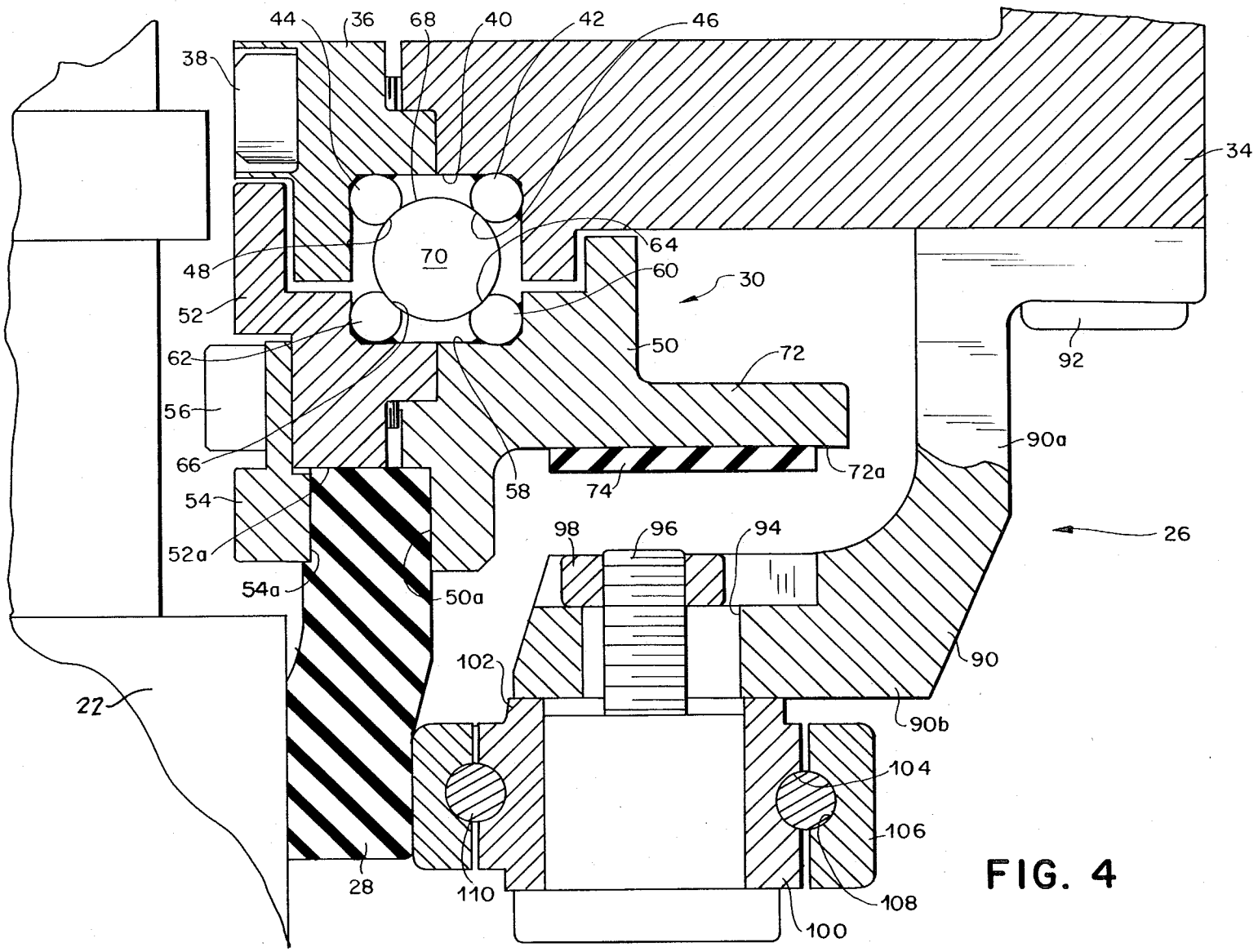
FIG. 4 is an enlarged cross-sectional view of a portion of the mandrel rotation assembly of FIG. 3.

Mandrel wheel 14 is then rotated to the next position B, which is the pre-treatment station at which the outer surface of cup 12 is pre-treated with a gas flame or with an electric discharge in order to better adhere the ink at the next print station C. In accordance with the present invention, as will be described in greater detail hereinafter, each mandrel assembly 18 at pre-treatment station B is rotated by a mandrel rotation assembly 26 (FIGS. 2–4). Since the cup 12 is held firmly on the mandrel assembly 18 at pre-treatment station B by means of a vacuum applied through apertures 24, the cup 12 at position B is also caused to rotate, so as to provide an even pre-treatment along the entire external surface of cup 12.

Mandrel wheel 14 is then rotated to print station C, where a printing blanket contacts the cup 12 thereat, and causes it to rotate, thereby printing on the external surface thereof. During the next intermittent step, mandrel wheel 14 is moved so that cup 12 is moved to position D, which is a dead station, that is, no action occurs there. At the next position E which is a first cure station, the ink is cured or dried by ultraviolet light. Each mandrel assembly 18 is rotated or spun during the curing operation at position E. At position F, a second cure by ultraviolet light occurs, with mandrel assembly 18 again being rotated or spun, whereby cup 12 thereat is also rotated or spun.

At unloading station G, cup 12 is unloaded from the respective mandrel assembly 18. Specifically, the vacuum applied through apertures 24 is released, and an air blast from the pressurized air supply (not shown) blows the cup off the mandrel assembly 18 in the direction of the arrow shown, to a collecting device, generally through a tube.

As shown in FIGS. 2–4, mandrel rotation assembly 26 includes a rubber ring 28 held by a rotatable clamping assembly 30 in concentric relation about a stationary central hub 32 and in concentric relation to mandrel wheel 14. Specifically, an annular inner stationary support 34 is secured to central hub 32 and an annular outer stationary support 36 is secured to inner stationary support 34 by a plurality of bolts 38 or the like. In assembled condition, inner stationary support 34 and outer stationary support 36 form a recess 40, and two circular guides 42 and 44 are secured in opposite corners of recess 40 and are provided with outwardly facing arcuate races 46 and 48, respectively.

Clamping assembly 30 includes an annular inner rotatable support 50, an annular intermediate rotatable support 52 and an annular outer rotatable support 54, each secured together by a plurality of bolts 56 into a unitary assembly in surrounding relation to inner stationary support 34 and outer stationary support 36. In assembled condition, inner rotatable support 50 and intermediate rotatable support 52 define a recess 58 in opposing relation to recess 40. Circular guides 60 and 62 are secured in the ends of recess 58, that is, to inner rotatable support 50 and intermediate rotatable support 52, respectively, and are provided with arcuate races 64 and 66, respectively. Races 46, 48, 64 and 66 are arranged on the external surface of a common circle 68. With this arrangement, a plurality of ball bearings 70, centered on circle 68, are positioned so as to ride along races 46, 48, 64 and 66, and to thereby rotatably support the assembly of inner rotatable support 50, intermediate rotatable support 52 and outer rotatable support 54.

Inner rotatable support 50 and outer rotatable support 54 extend to a greater radial dimension than intermediate rotatable support 52, and thereby define an annular recess between the outer axial end face 50*a* of inner rotatable support 50, the radial end face 52*a* of intermediate rotatable support 52 and the inner axial end face 54*a* of outer rotatable support 54, such that annular rubber ring 28 is positioned within such recess and clamped between outer end face 50*a* and inner end face 54*a* prior to tightening bolts 56. Thus, rubber ring 28 is rotatable with the assembly formed of inner rotatable support 50, intermediate rotatable support 52 and outer rotatable support 54, by ball bearings 70.

In order to rotatably drive rubber ring 28, inner rotatable support 50 is formed with an inwardly directed projection 72 having an outer circular surface 72*a* about which a belt 74 is positioned. As will now be discussed, belt 74 is caused to rotate and, because of its engagement with outer circular surface 72*a*, inner rotatable ring 50 and rubber ring 28 are likewise caused to rotate.

As shown particularly in FIGS. 2 and 3, a first pulley 76 is mounted on a drive shaft 78 connected to a motor 80, either directly or indirectly through a suitable linkage. A drive belt 82 is connected between first pulley 76 and a second pulley 84 for driving the latter pulley. Second pulley 84 is fixed on a rotatable shaft 86, and a third pulley 88 is fixed on an opposite end of rotatable shaft 86. As shown in FIG. 2, belt 74, in addition to being in engagement with outer circular surface 72*a*, is positioned about third pulley 88 and is driven thereby. Accordingly, belt 74 is rotatably driven by motor 80, through drive shaft 78, first pulley 76, drive belt 82, second pulley 84, rotatable shaft 86 and third pulley 88. Accordingly, belt 74, as aforementioned, provides continuous rotation of rubber ring 28. It will therefore be appreciated that a single rotational drive is provided. However, this rotational drive for belt 74 is different from the rotational drive for mandrel wheel 14 and the remainder of apparatus 10. This means that the rotational speed of mandrel assemblies 18 can be varied independently of the rotational speed of mandrel wheel 14. This is improtant, since there are certain times that it is desirable to increase the rotational speed of mandrel assemblies 18, for example, depending on the material of the container.

In accordance with the present invention, a stationary support 90 having a substantially L-shaped configuration is secured to inner stationary support 34 at each station by means of at least one bolt 92. Alternatively, stationary supports 90 can be provided only at pre-treatment station B and first and second cure stations E and F. As shown in FIG. 4, stationary support 90 includes a first radial leg 90*a* and a second axial leg 90*b* extending from the free end of first radial leg 90*a* and extending outwardly in surrounding relation to inwardly directed projection 72 of inner rotatable support 50 and spaced therefrom. The free end of second axial leg 90*b* is provided with an elongated slot 94 extending therethrough. A screw-threaded stud 96 extends through slot 94 and has a nut 98 received on the radially inner end thereof. Nut 98 has an outer dimension which is greater then the widthwise direction of slot 94 so that it cannot pass through slot 94. A hub 100 is connected to the opposite end of stud 96 and includes an annular raised section 102 which engages the radially outer surface of second axial leg 90*b* when nut 98 is tightened. Specifically, when nut 98 is tightened on stud 96, stud 96 is pulled inwardly, that is, upwardly in FIG. 4, so that annular raised section 102 engages the radially outer surface of second axial leg 90*b*, thereby locking stud 96 in position.

Hub 100 is provided with an annular race 104 and a roller 106 having a corresponding annular race 108 is positioned about hub 100. A plurality of ball bearings 110 ride within races 104 and 108 and thereby rotatably support roller 106 on hub 100.

In accordance with the present invention, prior to operation, at pre-treatment station B, first cure station E and second cure station F, nut 98 is loosened and stud 96 is moved in slot 94 toward rubber ring 28 until roller 106 abuts against and biases the free end of rubber ring at these stations against shaft 22 of the mandrel assemblies 18 thereat. Then, nut 98 is tightened to retain rubber ring 28 at such stations with such a fixed deformation. Then, operation its started. Since rubber ring 28 is continuously rotating, even though mandrel wheel 14 is intermittently rotated, rubber ring 28 thereby causes rotation of the mandrel assemblies 18, and containers 12 thereon, at pre-treatment station B, first cure station E and second cure station F due to the biasing of rubber ring 28 by roller 106 into engagement with the shafts 22.

Thus, with the present invention, mandrel assemblies 18 at selected stations can be rotated from a single drive. In addition, it is extremely easy to select the stations at which rotation is to occur by merely moving stud 96, and thereby roller 106, to the left or right of FIG. 4. For example, if it is desired to change the first cure station to dead position D, this can readily be performed by merely shifting roller 106 at such position so that it engages and biases rubber ring 28 thereat.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined in the appended claims.

What is claimed is:

1. Apparatus for decorating containers comprising:

(a) a mandrel wheel rotatably movable to a plurality of different stations;

(b) a plurality of mandrel assembly means mounted on said mandrel wheel for holding said containers on said mandrel wheel; and (c) means for rotating said containers at selected ones of said stations, said means for rotating including (1) a resilient ring rotatably mounted and extending adjacent to said plurality of mandrel assembly means;

(2) drive means for continuously rotating said resilient ring; and (3) biasing and deforming means for biasing said resilient ring into engagement with each mandrel assembly means at the selected stations to rotate said containers thereat.

2. Apparatus according to claim 1; further including mounting means for rotatably mounting said resilient ring in concentric relation to said mandrel wheel.

3. Apparatus according to claim 1; wherein said mounting means includes clamp means for clamping said ring, and bearing means for rotatably mounting said clamp means adjacent to said plurality of mandrel assembly means.

4. Apparatus according to claim 3; wherein said bearing means includes a thread bearing for mounting said clamp means in concentric relation to said mandrel wheel.

5. Apparatus according to claim 3; wherein said drive means includes belt means in engagement with said clamp means for rotating said clamp means, and motor means for controlling said belt means to drive said clamp means.

6. Apparatus according to claim 1; further including a stationary support at each station, each stationary support including a slot therein; and wherein said biasing means includes roller means rotatably mounted on a shaft at each rotation for engaging with said resilient ring, each said shaft being slidably mounted in a respective slot, and locking means for locking said shaft at a fixed position in the respective slot.

7. Apparatus according to claim 6; wherein said biasing means includes bearing means for rotatably mounting each said roller means on a respective shaft in a freely rotating manner.

8. Apparatus according to claim 7; wherein said locking means includes hub means secured on one end of each said shaft. and surrounded by the respective bearing means, for engaging with a first surface of said stationary support at one end of the respective slot, and nut means screw threadedly received on the opposite end of said shaft and engageable with said stationary support at an opposite end of the respective slot for tightening said hub means against said stationary support, and thereby locking said shaft at a fixed position in the respective slot.

9. Apparatus according to claim 1; further including a loading station at which the containers are loaded on the mandrel assembly means, a pre-treatment station at which a pre-treatment is applied to said containers, a print station at which the containers have printing ink applied thereon, at least one cure station at which the printing ink is cured on the containers and an unload station at which the containers are unloaded from the mandrel assembly means.

10. Apparatus according to claim 9; wherein said biasing means biases said resilient ring into engagement with each mandrel assembly means at least at the pre-treatment and cure stations to rotate the containers thereat.

11. Apparatus according to claim 1; wherein each said mandrel assembly means includes a container support section having an outer surface for application of a vacuum to said outer surface to maintain said containers on said container support section of each said mandrel assembly means.

12. Apparatus according to claim 11; wherein tne outer surface of each said container support section includes a plurality of apertures in said outer surface fur supplying said vacuum to said outer surface.

13. Apparatus for decorating containers, comprising:

(a) a mandrel wheel rotatably movable to a plurality of different stations;

(b) a plurality of mandrel assembly means mounted on said mandrel wheel for holding said containers on said mandrel wheel;

(c) a stationary support at each station, each stationary support including a slot therein;

(d) means for rotating said containers at selected ones of said stations, said means for rotating including (1) a resilient ring rotatably mounted and extending adjacent to said plurality of mandrel assembly means;

(2) mounting means for rotatably mounting said resilient ring in concentric relation to said mandrel wheel, said mounting means including (i) clamp means for clamping said ring; and (ii) bearing means for rotatably mounting said clamp means adjacent to said plurality of mandrel assembly means;

(3) drive means for continuously rotating said resilient ring, said drive means including (i) belt means in engagement witn said clamp means for rotating said clamp means; and (ii) motor means for controlling said belt means to drive said clamp means; and (4) biasing and deforming means for biasing said resilient ring into engagement with each mandrel assembly means at the selected stations to rotate said containers thereat, said biasing means including (i) roller means rotatably mounted at each station for engaging said resilient ring, each said roller means being movable toward and away from said resilient ring; and (ii) locking means positioned in a respective slot for locking each said roller means at a flxed position with respect to said resilient ring.

* * * * *